US010421110B2

(12) United States Patent
Chen et al.

(10) Patent No.: US 10,421,110 B2
(45) Date of Patent: Sep. 24, 2019

(54) MOLD TOOL

(71) Applicants: Shu-Hui Chen, Taichung (TW); Oliver Sir, Magalia, CA (US)

(72) Inventors: Shu-Hui Chen, Taichung (TW); Oliver Sir, Magalia, CA (US)

( * ) Notice: Subject to any disclaimer, the term of this patent is extended or adjusted under 35 U.S.C. 154(b) by 477 days.

(21) Appl. No.: 15/345,522

(22) Filed: Nov. 8, 2016

(65) Prior Publication Data

US 2018/0126438 A1 May 10, 2018

(51) Int. Cl.

| | |
|---|---|
| ***B21D 19/08*** | (2006.01) |
| ***B21D 22/08*** | (2006.01) |
| ***B21D 37/06*** | (2006.01) |
| ***B21D 41/02*** | (2006.01) |

(52) U.S. Cl.

CPC ..... *B21D 19/08* (2013.01); *B21D 37/06* (2013.01); *B21D 41/026* (2013.01); *B21D 22/08* (2013.01); *B21D 41/021* (2013.01); *B21D 41/025* (2013.01)

(58) Field of Classification Search

CPC .. B21D 41/021; B21D 41/025; B21D 41/026; B21D 22/08; B21D 37/04; B21D 37/06; B21D 39/08; B21D 39/20; B21D 19/08; B21D 19/12

USPC ... 72/116, 117, 317, 370.06, 370.01–370.04, 72/370.1–370.13, 409.19

See application file for complete search history.

(56) References Cited

U.S. PATENT DOCUMENTS

| | | | | | |
|---|---|---|---|---|---|
| 2,489,360 | A * | 11/1949 | Bachli | B21D 41/021 | 72/116 |
| 2,595,036 | A * | 4/1952 | Wolcott | B21D 41/021 | 72/116 |
| 3,052,279 | A * | 9/1962 | Collin | B21D 41/021 | 72/317 |
| 2016/0136718 | A1 * | 5/2016 | Lee | B29C 57/04 | 72/117 |

FOREIGN PATENT DOCUMENTS

| | | | | |
|---|---|---|---|---|
| EP | 0133952 | A1 * | 3/1985 | B21D 19/16 |
| TW | M303782 | | 1/2007 | |
| WO | WO-2016045419 | A1 * | 3/2016 | F16L 19/02 |

OTHER PUBLICATIONS

Machine Translation of WO 2016045419, Translated Mar. 5, 2019, 10 Pages (Year: 2016).*

* cited by examiner

*Primary Examiner* — Gregory D Swiatocha

(57) ABSTRACT

A mold tool generally includes a base, a die assembly, a tightening element, a threaded element, and at least one shaping cap. The base defines a cutout, a first threaded hole opposite to the cutout, and a second threaded hole. The die assembly, composed of a first module and a second module, can be inserted into a receiving space of the base. The tightening element can be screwed into the second threaded hole of the base to fix the die assembly in place. The threaded element can be screwed into the first threaded hole of the base. The shaping cap can be fitted at one end of the threaded element. The die assembly defines channels of various diameters each for holding a tube of a specific diameter. The shaping cap can urge one end of a tube held in the die assembly to form a specific type of flare.

8 Claims, 11 Drawing Sheets

MOLD TOOL

BACKGROUND OF THE INVENTION

1. Field of the Invention

The present invention relates to a mold tool, and, more specifically to a mold tool that can be applied to tubes or pipes for the purpose of crimping/molding/fashioning specific shapes onto any open-ended portion or tip(s) of said tubes or pipes regardless of their specific & unique. OD/ID. Wherein, the mold tool incorporates a "clamshell turret" within its cavities, accepting these tubes or pipes having different diameters.

2. Description of the Prior Art

In many engineering fields, such as refrigeration engineering or mechanical engineering, etc., (automotive/aviation/marine/HD industries) there exists a pipe and/or plumping system which transports, houses or maintains under pressure fluids or gases, etc. When repairing a pipe, after the damaged section of the pipe is cut off, the remaining pipe sections can be flared, and then a new pipe can be joined between the remaining pipe sections. For conducting such works, a mold tool is required. There are various mold tools available in the market. Some existing mold tools are hydraulically operated equipment, which is complicated, comprised of numerous individual pieces required, bulky, and heavy, and thus uneasy to be carried or cumbersome & unable to fit inside or access a confined space at the area of the repair of the pipe where the flare is necessary for that specific pipe.

To increase the portability, a conventional tube expender, issued as Taiwan Utility Model Patent M303782, was disclosed, which generally includes a main body, a cap, an expander, an operation lever, and a (built-in threaded press system or incorporated) pushing stem. The main body is formed integrally with an elongated handle and defines therein a passage. The cap is mounted on a front threaded portion of the main body and can retain the expander that extends out of the cap to be inserted into one end of a pipe or tube. The pushing stem is movably mounted through the passage of the main body and has a cone-shaped head engaged with the expander. The operation lever is pivotally connected to the main body and can drive the pushing stem to have the expander to enlarge one end of a pipe or tube.

However, for application of the conventional tube expander, a pipe or tube should be heated in advance to a temperature that allows an easy shaping of the pipe. During the heating process and the subsequent annealing process, the surface of the pipe is liable to become black, or subjected to other materials to be stained, and thus an abrasive cloth or a chemical solution is required to remove the blackened or stained appearance. Besides, after the pipe has been expanded and cooled, the end of the pipe may become brittle or uneven.

SUMMARY OF THE INVENTION

One object of the present invention is to provide a mold tool which can be applied to tubes (pipes and/or plumbing) having different diameters.

The mold tool comprises a base, a die assembly, a tightening element, a threaded element, and at least one shaping cap. The base defines a receiving space, a cutout at a first side thereof communicating with the receiving space, a first threaded hole at a second side thereof being opposite to the cutout and communicating with the receiving space, a second threaded hole at a third side thereof, and a through hole at a fourth side opposite to the third side for receiving therein a first magnetic member. The base is provided with an extension portion at a bottom thereof. The die assembly, which can be inserted into the receiving space of the base, is composed of a first module and a second module that are configured in mirror symmetry. Each module defines a plurality of grooves at one side thereof. Each groove has a first recessed portion and a second recessed portion, wherein each recessed portion is configured to be semicircular in a cross section taken along a plane perpendicular to the side of the module at which the grooves are defined; the second recessed portion of each groove has a diameter less than the first recessed portion of the groove; a chamfer is formed between the first recessed portion and the second recessed portion in each groove. The grooves of the first module and the corresponding grooves of the second module are combined to form a plurality of through channels of different diameters, wherein each through channel is capable of receiving a tube desired to be flared, and information of standard and size suitable for the tube is provided at a face of the first module or the second module associated with the through channel (this in effect is a "clamshell turret" accepting multiple O.D.'s & the number of pass through channels that are currently equipped within this mechanism is NOT limited to its current number count. Meaning this is an open variable "Plus" or "Minus" from its current state and this is just one of the elements that's extremely unique and is claimed within this summary of invention). The tightening element is provided at one end with a threaded portion that defines therein a recess for receiving a second magnetic member, wherein the threaded portion of the tightening element is allowed to be screwed into the second threaded hole of the base. The threaded element has a first threaded portion and a second threaded portion formed integrally with the first threaded portion. Either of the first and second threaded portions can be screwed into the first threaded hole of the base. The first threaded portion is provided at its free end with a flat end surface, and the second threaded portion is provided at its free end with a mating protrusion that defines therein a recess for receiving a third magnetic element. The shaping cap defines a mating recess at one end and is provided with a tube urging portion at another end, wherein the mating recess can be fitted over the mating protrusion of the threaded element.

According to one aspect of the present invention, the die assembly is in the form of a multi-faced body, and the base has multiple internal surfaces that constitute the boundaries of the receiving space for mating with the multi-faced body.

According to a second aspect of the present invention, the first module is provided with at least one positioning protrusion at the side where the grooves of the first module are defined, and the second module defines at least one positioning recess at the side where the grooves of the second module are defined, the positioning protrusion capable of being inserted into the positioning recess.

According to a third aspect of the present invention, the threaded element further has a middle portion integrally formed between the first and second threaded portions, the middle portion having multiple sides to facilitate a wrench turning the threaded element.

According to a fourth aspect of the present invention, multiple shaping caps are provided for application to tubes having different diameters or for shaping different types of flares on the tubes.

According to a fifth aspect of the present invention, the tube urging portion of the shaping cap is formed into a recessed cone with a central protrusion.

According to a sixth aspect of the present invention, the tube urging portion of the shaping element is formed into a forwardly extending cone with a central protrusion. According to a seventh aspect of the present invention, the mold tool may further comprise an elongated handle with a threaded portion at one end thereof, and the extension portion of the base defines a third threaded hole, wherein the elongated handle can be attached to the extension portion of the base by screwing the threaded portion thereof into the third threaded hole.

The advantages of the mold tool are that the tool can be applied to tubes having different diameters for making various flares, occupies less space, and can be carried easily (this in effect is a "clamshell turret" accepting multiple O.D.'s & the number of pass through channels that are currently equipped within this mechanism is NOT limited to its current number count. Meaning this is an open variable "Plus" or "Minus" from its current state and this is just one of the elements that's extremely unique and is claimed within this summary of invention).

Other objects, advantages, and novel features of the present invention wilt become more apparent from the following detailed description when taken in conjunction with the accompanying drawings.

DETAILED DESCRIPTION OF THE PREFERRED EMBODIMENTS

The following paragraphs will illustrate the objects and effects of the present invention via a preferred embodiment taken in conjunction with the accompanying drawings.

Figure 1:
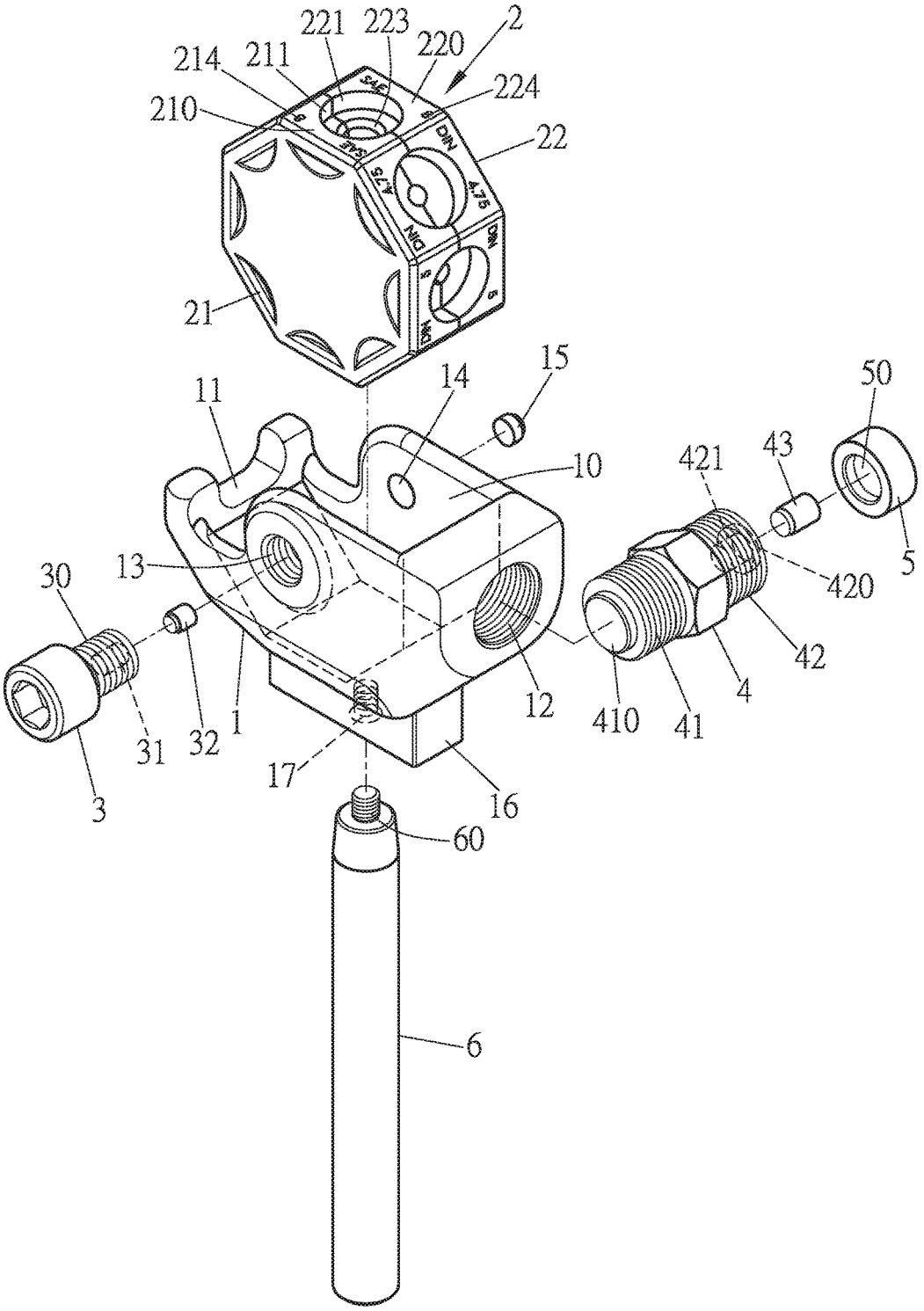
FIG. 1 shows an exploded view of a mold tool according to one embodiment of the present invention.
Figure 2:
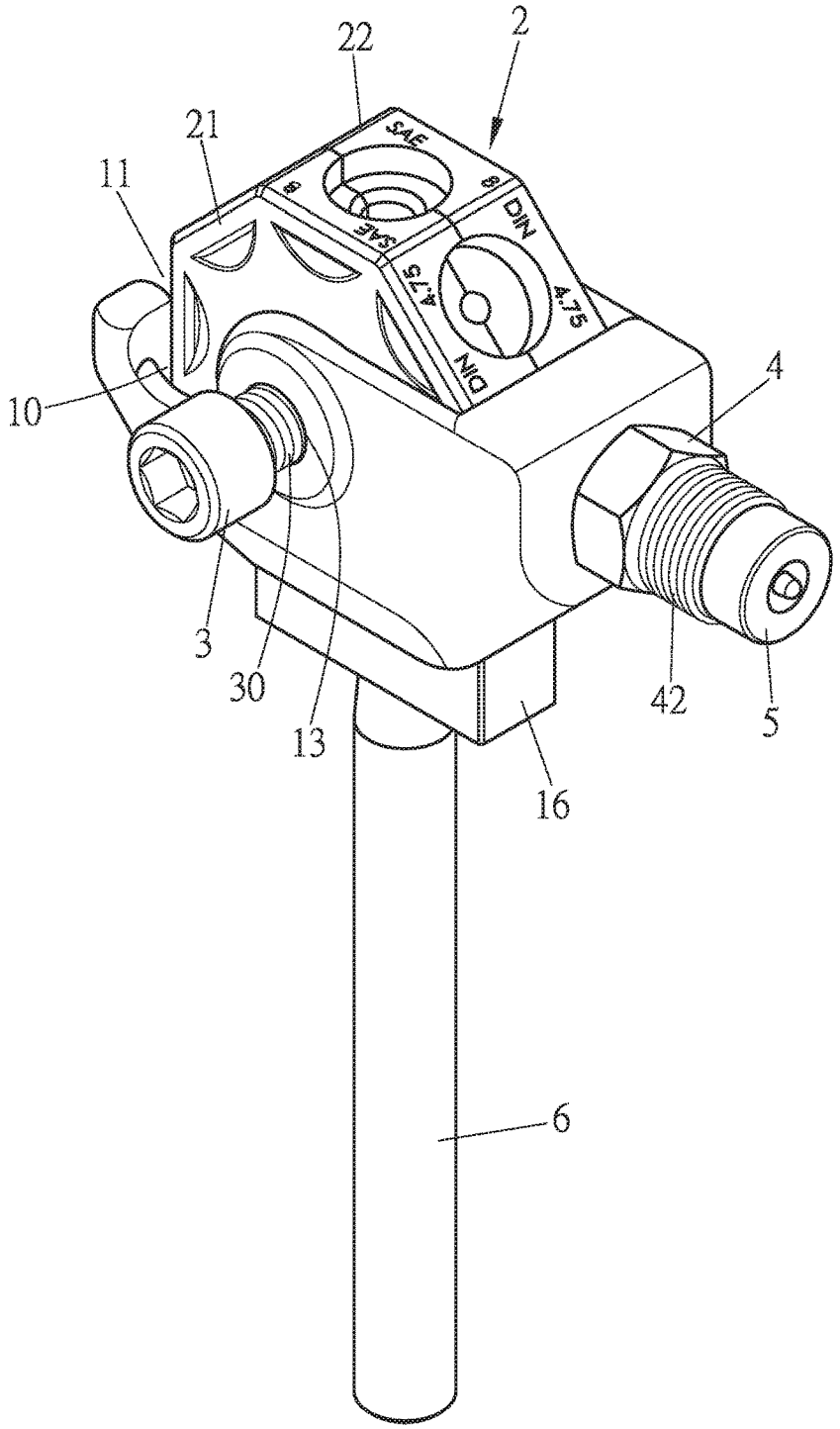
FIG. 2 shows a 3-dimensional view of the mold tool.
Figure 3:
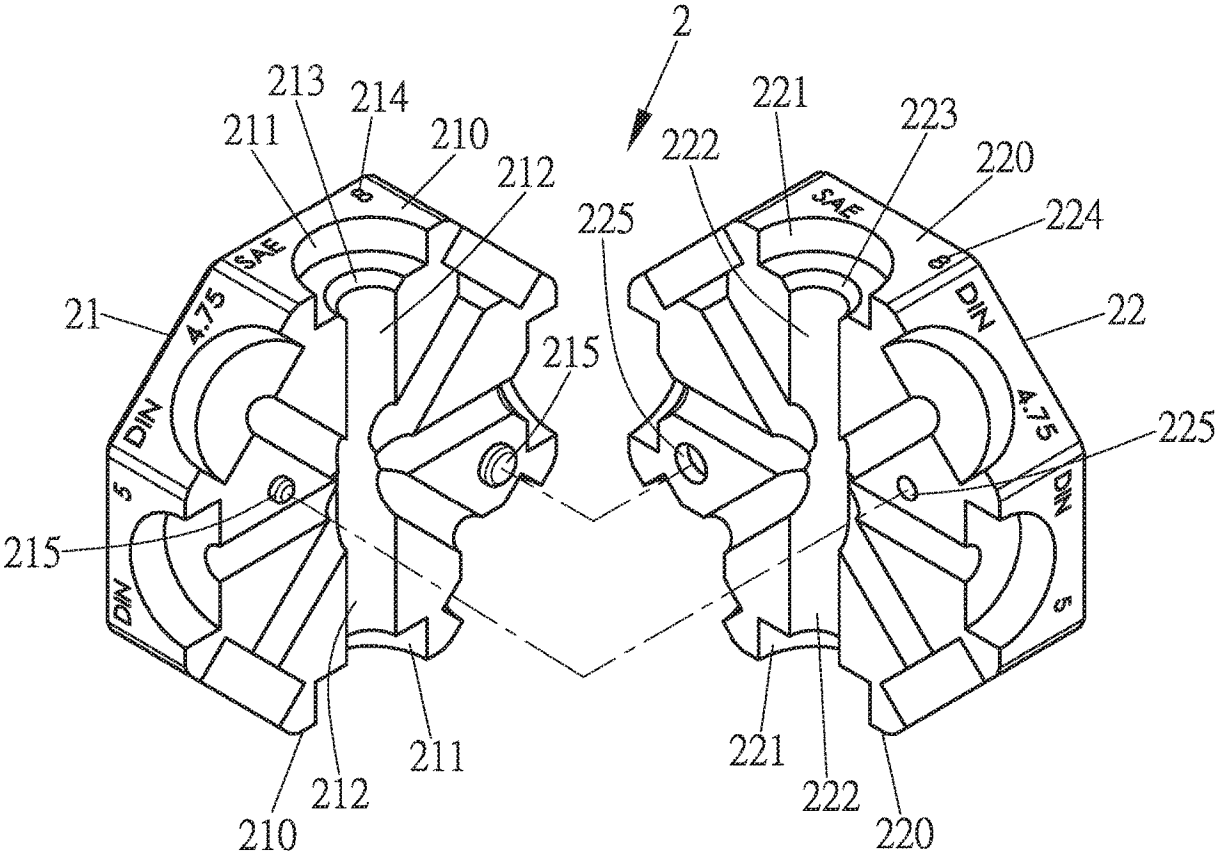
FIG. 3 shows an exploded view of a die assembly used in the mold tool.
Figure 4:
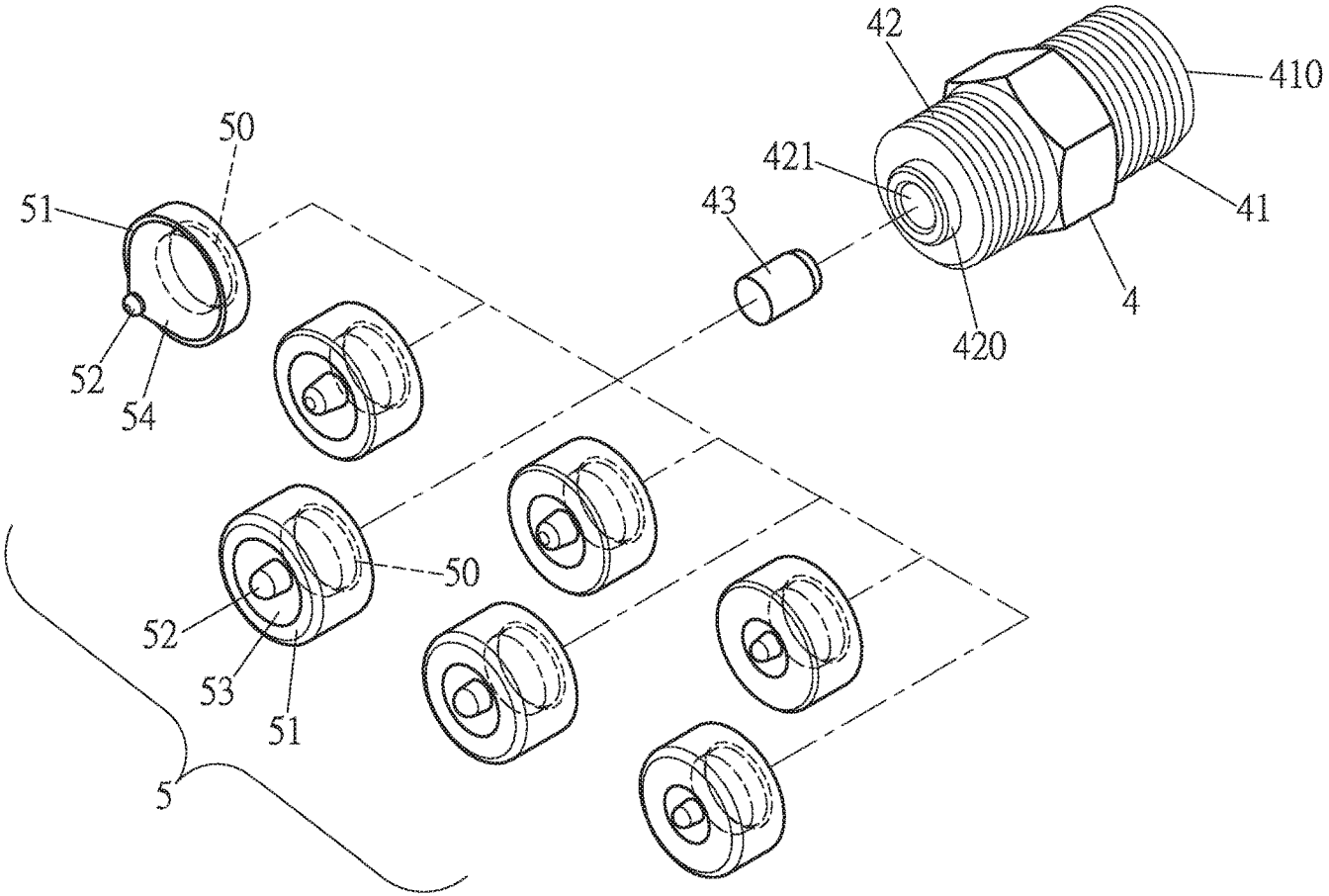
FIG. 4 shows a schematic view of a threaded element and a set of shaping caps used in the mold tool.

Referring to FIGS. 1 through 4, a mold tool according to one embodiment of the present invention is shown, which generally comprises a base 1, a die assembly 2, a tightening element 3, a threaded element 4, one or more shaping caps 5, and an elongated handle 6. As shown, the base 1 defines a receiving space 10, a cutout 11 at a first side thereof communicating with the receiving space 10, a first threaded hole 12 at a second side thereof being opposite to the cutout 11 and communicating with the receiving space 10, a second threaded hole 13 at a third side thereof, and a through hole 14 at a fourth side opposite to the third side for receiving therein a first magnetic member 15. In this embodiment, the base 1 has multiple internal surfaces that constitute the boundaries of the receiving space 10 for mating with the die assembly 2 that is in the form of a multi-faced body. Furthermore, the base 1 is provided at a bottom thereof with an extension portion 16 that defines a third threaded hole 17. The die assembly 2 is in the form of a multi-faced body, such as a hexagonal prism or an octagonal prism. In this embodiment, the die assembly 2 is implemented as an octagonal prism, which can be inserted into the receiving space 10 being delimited by multiple internal surfaces of the base 1. The die assembly 2 can be obtained by assembling two symmetrical bodies: a first module 21 and a second module 22, both of which are configured in mirror symmetry. In this embodiment, either of the two modules 21, 22 is an octagonal prism, which has two octagonal sides and eight rectangular faces 210, 220. Each module defines a plurality of grooves at one of the two octagonal sides thereof. Each of the grooves defined at the first module 21 includes two terminal recessed portions 211 and a middle recessed portion 212, wherein each recessed portion is configured to be semicircular in a cross section taken along a plane perpendicular to the octagonal side of the module at which the grooves are defined; the middle recessed portion 212 of each groove has a diameter less than either of the terminal recessed portions 211 of the groove; a chamfer 213 is formed between the middle recessed portion 212 and one of the terminal recessed portions 211 in each groove. Each of the grooves defined at the second module 22 includes two terminal recessed portion 221 and a middle recessed portion 222, which correspond to the recessed portions 211, 212 defined at the first module 21 and have the same structural features, wherein a chamfer 223 is formed between the middle recessed portion 222 and one of the terminal recessed portions 221 in each groove. The first module 21 is provided with two positioning protrusions 215 at the octagonal side where the grooves of the first module 21 are defined. The second module 22 defines two positioning recesses 225 at the octagonal side where the grooves of the second module 22 are defined. The positioning protrusions 215 can be inserted into the positioning recesses 225 to have the two modules 21, 22 assembled into the die assembly 2. The grooves of the first module 21 and the corresponding grooves of the second module 22 are combined to form a plurality of through channels of different diameters. Each of the through channels has a specific diameter for holding a tube corresponding thereto and desired to be flared. The standard (such as American National Standard, European Standard or the like) and size, indicated by reference numerals 214, 224, for each of the through channels for making a flare on one end of a tube is marked at the rectangular faces 210, 220 associated with the through channel. The tightening element 3 is provided at one end with a threaded portion 30 that defines therein a recess 31. A second magnetic member 32 can be received in the recess 31 of the tightening element 3. The threaded portion 30 of the tightening element 3 can be screwed into the second threaded hole 13 of the base 1. The threaded element 4 has a first threaded portion 41, a second threaded portion 42, and a middle portion integrally formed between the first and second threaded portions 41, 42. Either of the first and second threaded portions 41, 42 can be screwed into the first threaded hole 12 of the base 1. The middle portion has multiple sides to facilitate a wrench turning the threaded element 4. The first threaded portion 41 is provided at its free end with a flat end surface 410, and the second threaded portion 42 is provided at its free end with a mating protrusion 420 that defines therein a recess 421 in which a third magnetic element 43 can be fitted. As shown in FIG. 4, a plurality of shaping caps 5 are provided for applying to tubes having different diameters or for shaping different types of flares on ends of tubes. Each of the shaping caps 5 defines a mating recess 50 at one end and is provided with a tube urging portion 51 at another end, wherein the mating recess 50 can be fitted over the mating protrusion 420 of the threaded element 4. For some shaping caps, the tube urging portion 51 is formed into a recessed cone 53 with a central protrusion 52. For other shaping caps, the tube urging portion 51 is formed into a forwardly extending cone 54 with a central protrusion 52. The elongated handle 6 is provided at one end with a threaded portion 60. The elongated handle 6 can be attached to the extension portion 16 of the base 1 by screwing the threaded portion 60 into the third threaded hole 17 of the extension portion 16.

In assembling the above-mentioned parts, referring again to FIGS. 1 through 4, firstly, the first module 21 can be joined with the second module 22 by inserting the positioning protrusions 215 into the positioning recesses 225 to form a die assembly 2, wherein the corresponding octagonal sides of the two modules 21, 22 are located to face each other. Secondly, the first magnetic element 15 can be put in the through hole 14 of the base 1. Thirdly, the die assembly 2 can be inserted into the receiving space 10 of the base 1, wherein some of the rectangular faces 210, 220 of the two modules 21, 22 are brought in contact with the multiple internal surfaces of the receiving space 10. Fourthly, the second magnetic element 32 can be put in the recess 31 of the tightening element 3, and then the threaded portion 30 of the tightening element 3 is screwed into the second threaded hole 13 of the base 1 to have the die assembly 2 fixed in the receiving space 10 of the base 1, with the assistance of the first and second magnetic members 15, 32. Fifthly, the first threaded portion 41 of the threaded element 4 can be screwed into the first threaded hole 12 of the base 1. Sixthly, the third magnetic member 43 can be put in the recess 421 of the threaded element 4, and then one of the shaping caps 5 can be selected to fit over the mating protrusion 420 of the threaded element 4. Finally, the threaded portion 60 of the elongated handle 6 can be screwed into the third threaded hole 17.

Figure 5:
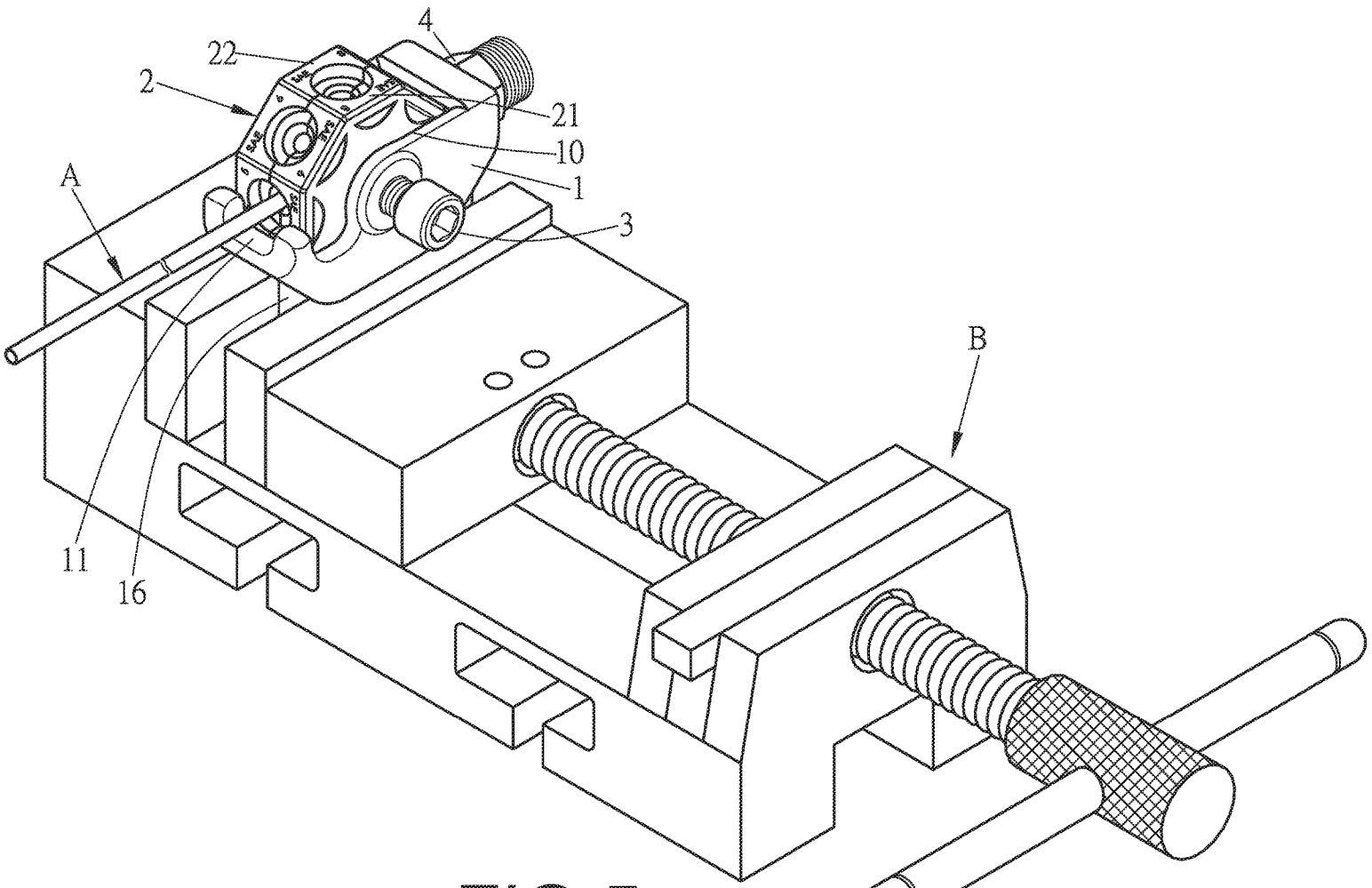
FIG. 5 shows a working view of the mold tool, wherein a vise is employed.
Figure 6:
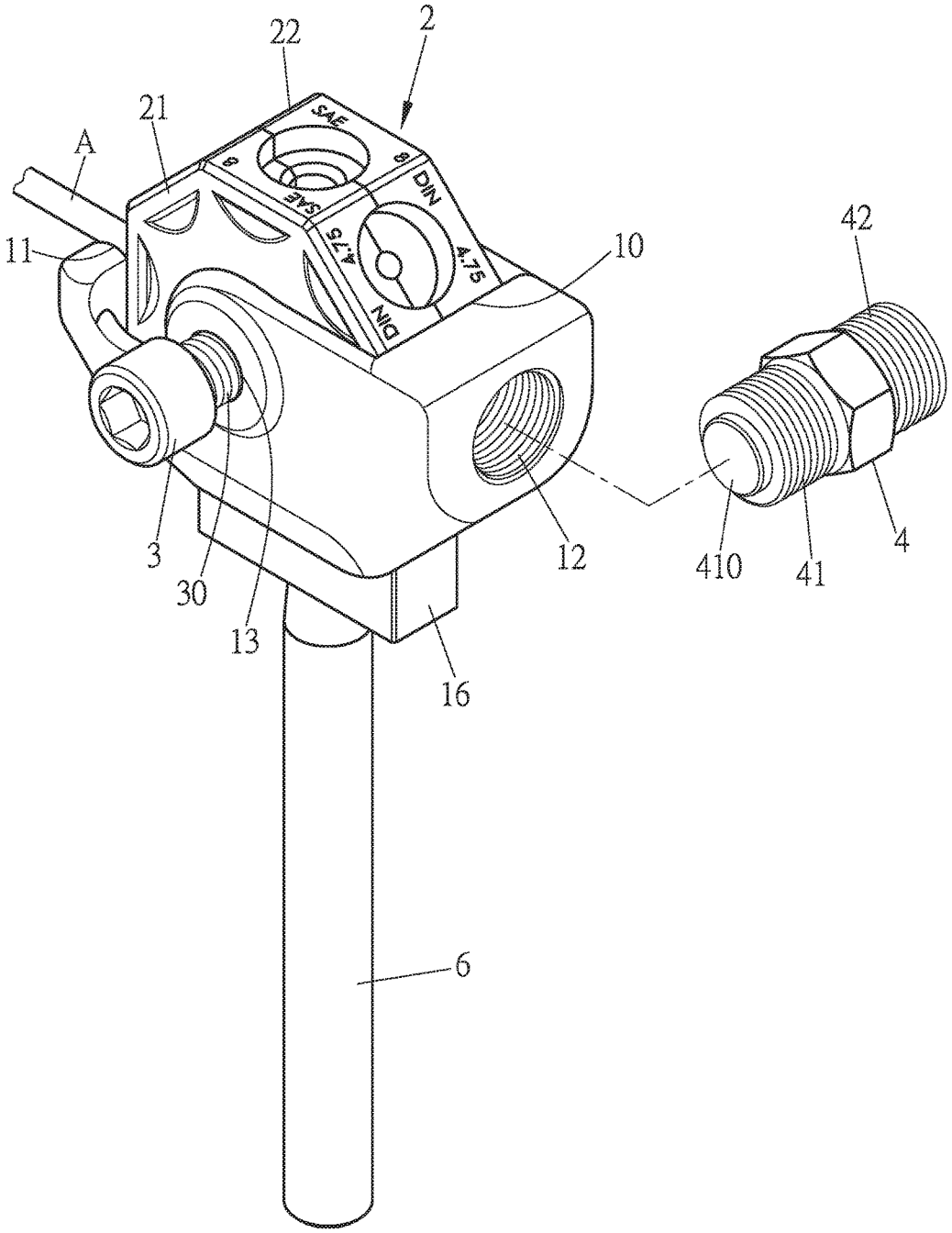
FIG. 6 shows a working view of the mold tool, wherein the threaded element is being assembled into a base of the mold tool by its first threaded portion.
Figure 7:
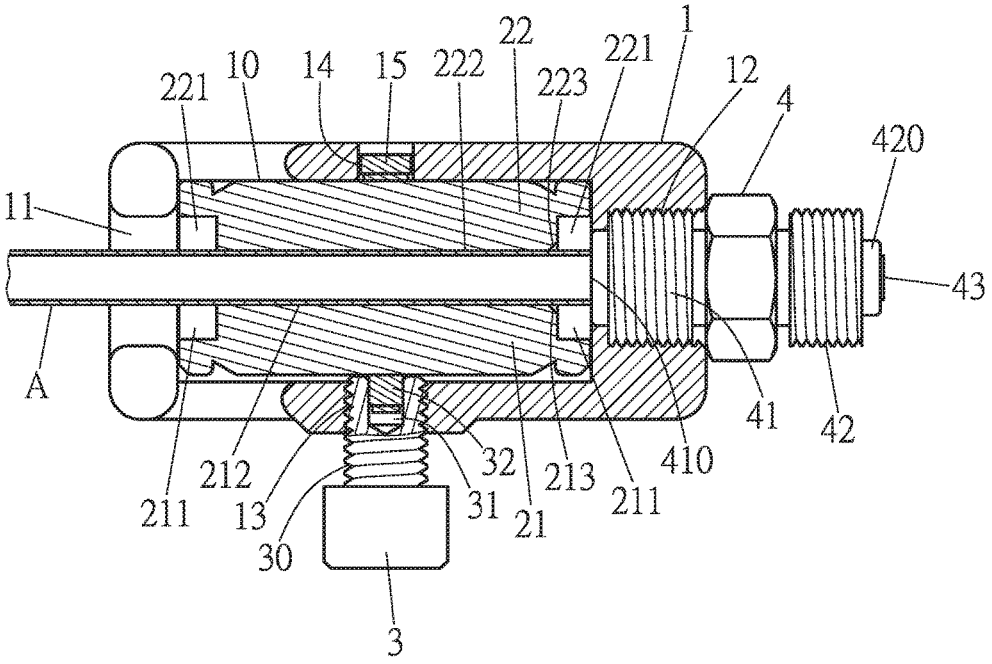
FIG. 7 shows a schematically sectional view of the mold tool, wherein the first threaded portion of the threaded element is used to locate a tube desired to be flared.
Figure 8:
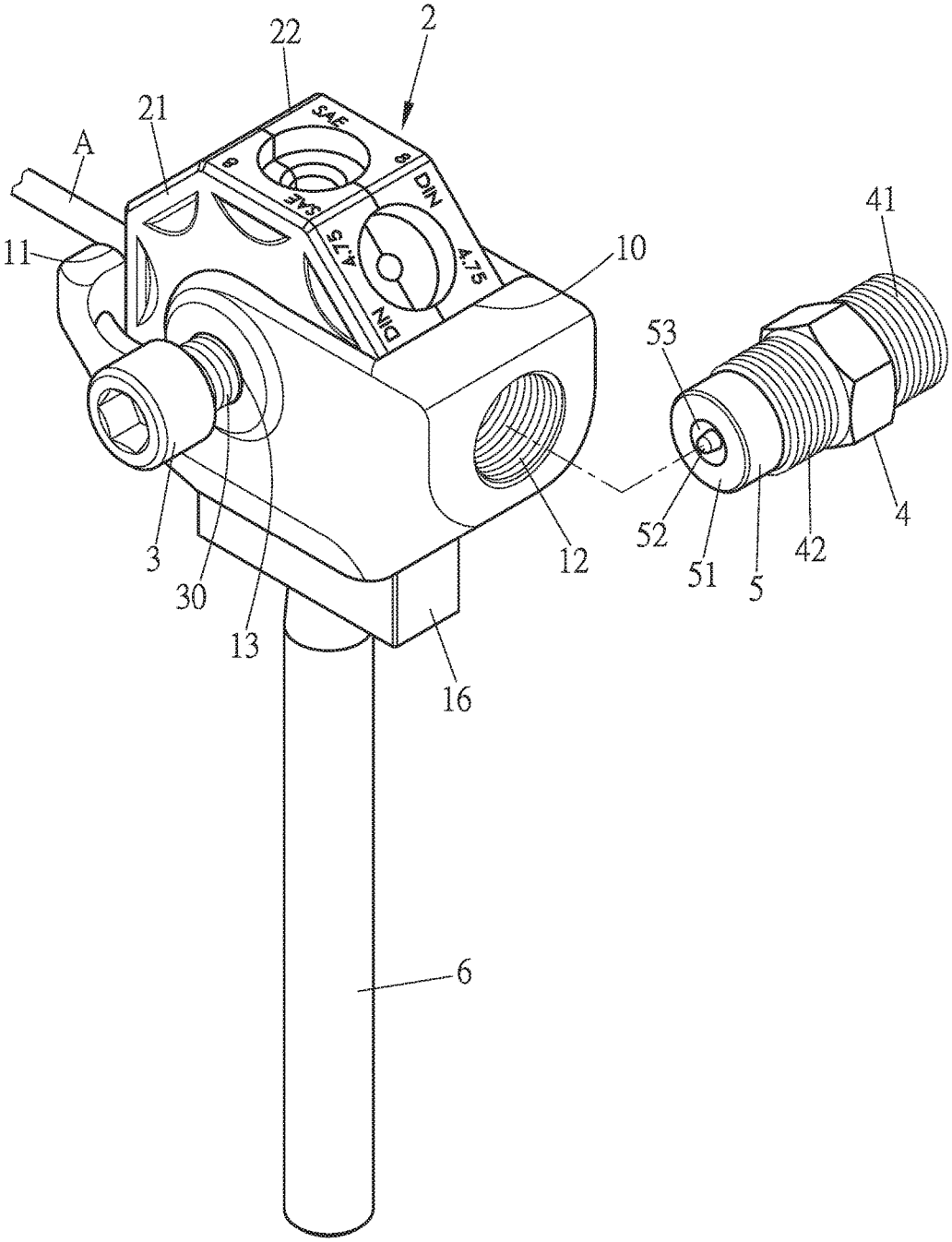
FIG. 8 shows a working view of the mold tool, wherein the threaded element is being assembled into the base of the mold tool by its second threaded portion fitted with a first shaping cap.
Figure 9:
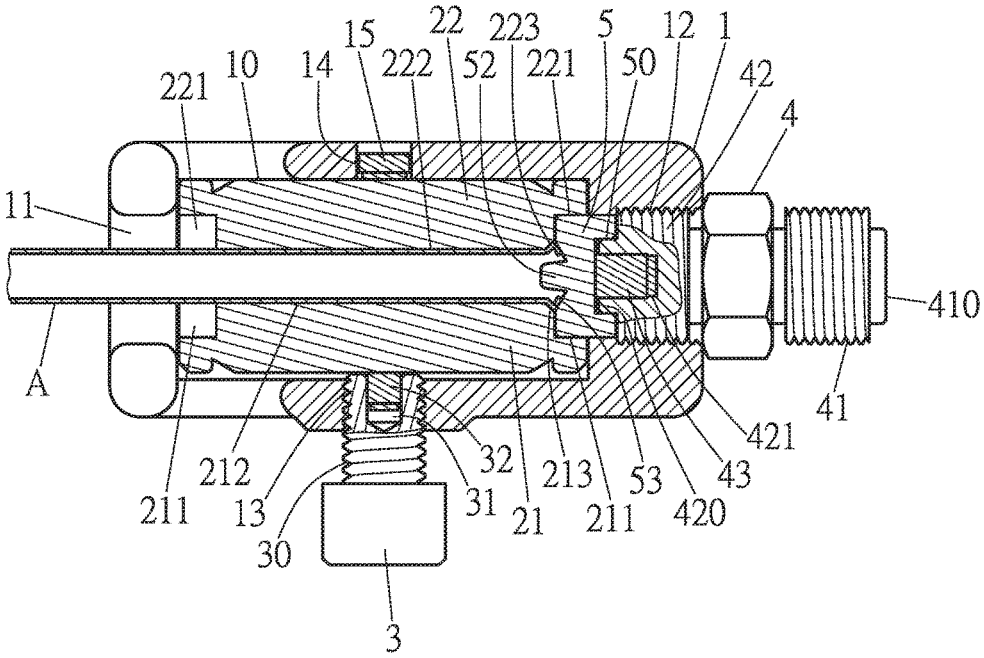
FIG. 9 shows a schematically sectional view of the mold tool, wherein the second threaded portion of the threaded element fitted with the first shaping cap is used to make a bubble-like flare on the tube.
Figure 10:
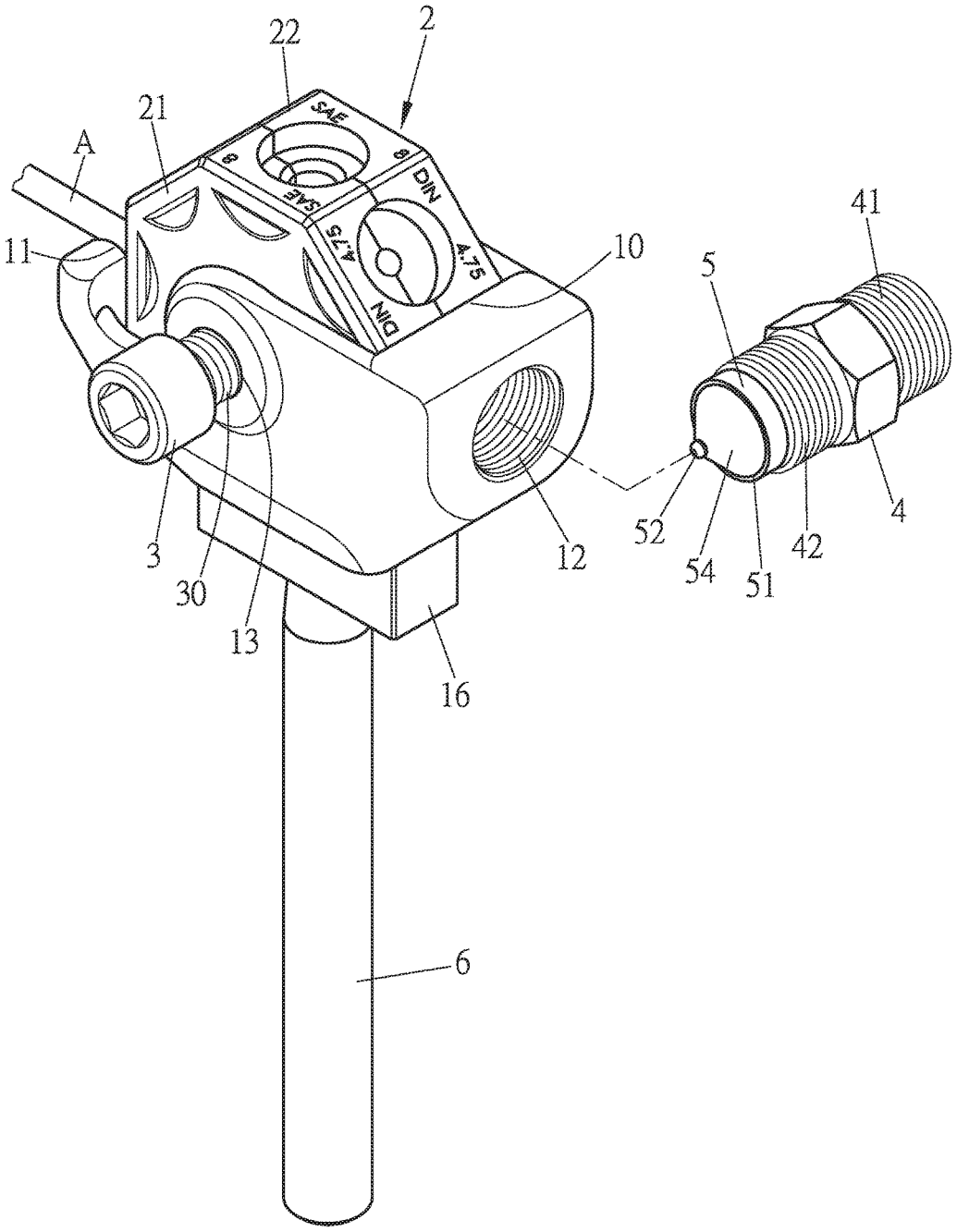
FIG. 10 shows a working view of the mold tool, wherein the threaded element is being assembled into the base of the mold tool by its second threaded portion fitted with a second shaping cap.
Figure 11:
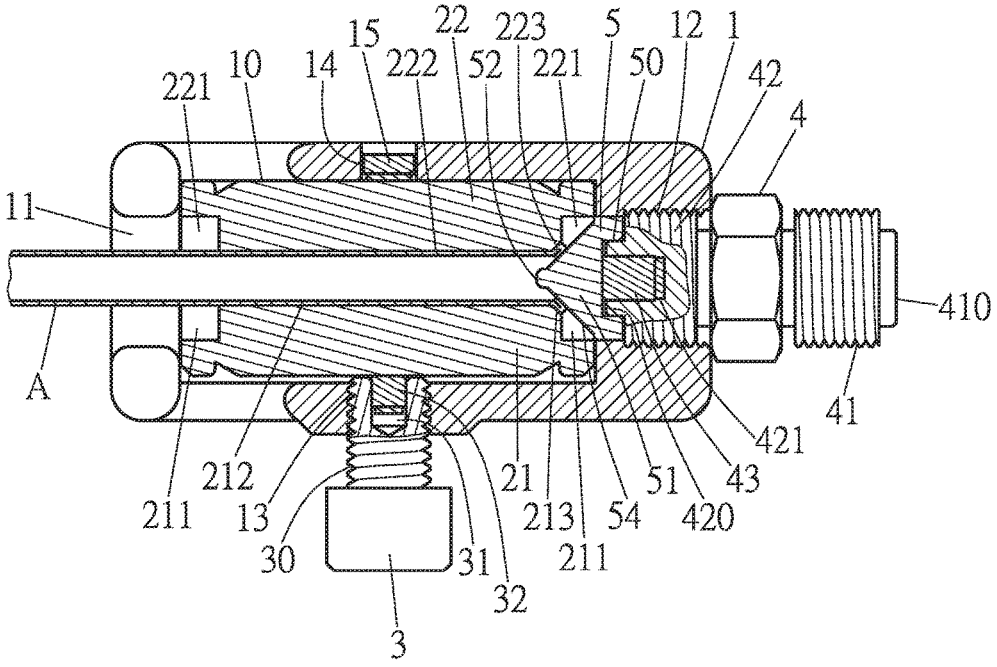
FIG. 11 shows a schematically sectional view of the mold tool, wherein the second threaded portion of the threaded element fitted with the second shaping cap is used to make a double flare on the tube.

In use, referring to FIGS. 5 through 11, firstly, the extension portion 16 of the base 1 can be clamped at a vise (B) for an easy operation (see FIG. 5). Secondly, the user selects one of the through channels of the die assembly 2 according to the standards (such as American National Standard, European Standard or the like) and sizes marked on the rectangular faces 210, 220 to be suitable for a tube (A) desired to be flared. Thirdly, the tube (A) can be inserted into the selected through channel formed in the die assembly 2. Fourthly, the die assembly 2 can be inserted into the receiving space 10 of the base 1, wherein the selected through channel is oriented to be aligned with the cutout 11 and the first threaded hole 12 of the base 1, and the terminal recessed portions 211, 221 with the chamfer 213, 223 are located adjacent to the first threaded hole 12 of the base 1. Fifthly, the tube (A) can be moved further into the selected through channel to reach the first threaded hole 12, and then the tightening element 3 is rotated to engage with the first module 21 so that the first and second modules 21, 22 may slightly hold the tube (A) (see FIGS. 6 and 7); under this circumstance, the tube (A) still allows to be moved along the channel by an external force. Sixthly, the first threaded portion 41 of the threaded element 4 can be gradually screwed into the first threaded hole 12 of the base 1, so that the flat end surface 410 of the first threaded portion 41 may contact one end of the tube (A) and thus can force the tube (A) to gradually move back until the middle portion of the threaded element 4 is in contact with the outer surface of the base 1. Since the first threaded portion 41 is designed to be screwed into the first threaded hole 12 at a predetermined depth, the tube (A) can be inserted into the channel at a proper depth. Thereafter, the tightening element 3 can be further screwed into the third threaded hole 13 to allow the first and second modules 21, 22 to hold the tube (A) securely (see FIGS. 8 and 9); under this circumstance, the tube (A) is unable to be moved anyway. Seventhly, the threaded element 4 can be released from the first threaded hole 12 of the base 1. Next, the threaded element 4 can be reversed, and a shaping cap 5, corresponding to the tube (A), can be selected to fit over the mating protrusion 420 of the second threaded portion 42 for shaping a type of flare on the tube (A). For example, a shaping cap 5 with a recessed cone 53 can be selected. Then, the second threaded portion 42 can be gradually screwed into the first threaded hole 12 of the base 1, wherein the central protrusion 52 of the shaping cap 5 can be inserted into the tube (A). Under the screwing action of the threaded element 4, the chamfers 213, 223 of the first and second modules 21, 22 and the recessed cone 53 allows the end of the tube (A) to expand and subsequently narrow to form a bubble-like flare (see FIG. 9). Eighthly, if a double flare is required, the threaded element 4 can be unscrewed from the first threaded hole 12 of the base 1 and another shaping cap 5 with a forwardly extending cone 54 can be selected to fit over the mating protrusion 420 of the threaded element 42 (see FIGS. 10 and 11), wherein the central protrusion 52 can be inserted into the tube (A). Then, the threaded element 4 can be again, gradually screwed into the first threaded hole 12 of the base 1 for conducting a second shaping operation. Under the screwing action of the threaded element 4, the forwardly extending cone 54 of the shaping cap 5 can fold the bubble-like edge of the tube back on itself to form a double flare.

The present invention employs the die assembly 2, which form a plurality of through channels of different diameters by combination of the grooves defined on the first and second modules 21, 22 for application to tubes having different diameters. In addition, various shaping caps 5 can be used to make different types of flares on tubes. Thus, a damaged tube can be repaired easily and quickly.

While the invention has been described with reference to the preferred embodiment above, it should be recognized that the preferred embodiment is given for the purpose of illustration only and is not intended to limit the scope of the present invention and that various modifications and changes, which will be apparent to those skilled in the relevant art, may be made without departing from the spirit and scope of the invention.

What is claimed is:

1. A mold tool for fashioning specific shapes, comprising:

a base defining a receiving space, a cutout at a first side of the base which communicates with the receiving space, a first threaded hole at a second side of the base which is opposite to the cutout and communicates with the receiving space, a second threaded hole at a third side of the base, and a through hole at a fourth side opposite to the third side for receiving therein a first magnetic member, the base being provided with an extension portion at a bottom thereof;

a die assembly capable of being inserted into the receiving space of the base and composed of a first module and a second module that are configured in mirror symmetry, each module defining a plurality of grooves at one side of each module, each groove having a first recessed portion and a second recessed portion, each recessed portion being configured to be semicircular in a cross section taken along a plane perpendicular to the side of the first and second modules at which the grooves are defined, the second recessed portion of each groove having a diameter less than the first recessed portion of the groove, a chamfer formed between the first recessed portion and the second recessed portion in each groove, wherein the grooves of the first module and the corresponding grooves of the second module are combined to form a plurality of through channels of different diameters, each through channel capable of receiving a tube desired to be flared, and information of standard and size suitable for the tube is provided at a face of the first module or the second module associated with the through channel;

a tightening element being provided at one end with a threaded portion that defines therein a recess for receiving a second magnetic member, wherein the threaded portion of the tightening element is allowed to be screwed into the second threaded hole of the base;

a threaded element having a first threaded portion and a second threaded portion formed integrally with the first threaded portion, either of the first and second threaded portions capable of being screwed into the first threaded hole of the base, wherein the first threaded portion is provided at a free end with a flat end surface, and the second threaded portion is provided at a free end with a mating protrusion that defines therein a recess for receiving a third magnetic element; and at least one shaping cap defining a mating recess at one end and is provided with a tube urging portion at another end, wherein the mating recess is capable of fitting over the mating protrusion of the threaded element.

2. The mold tool of claim 1, wherein the die assembly is in the form of a multi-faced body, and the base has multiple internal surfaces that constitute boundaries of the receiving space for mating with the multi-faced body.

3. The mold tool of claim 1, wherein the first module is provided with at least one positioning protrusion at the side where the grooves of the first module are defined, and the second module defines at least one positioning recess at the side where the grooves of the second module arc defined, the positioning protrusion capable of being inserted into the positioning recess.

4. The mold tool of claim 1, wherein the threaded element further has a middle portion integrally formed between the first and second threaded portions, the middle portion having multiple sides to facilitate a wrench turning the threaded element.

5. The mold tool of claim 1, wherein multiple shaping caps are provided for urging tubes having different diameters or for shaping different types of flares on the tubes.

6. The mold tool of claim 1, wherein the tube urging portion of the shaping cap is formed into a recessed cone with a central protrusion.

7. The mold tool of claim 1, wherein the tube urging portion of the at least one shaping cap is formed into a forwardly extending cone with a central protrusion.

8. The mold tool of claim 1, further comprising an elongated handle with a threaded portion at one end thereof, and wherein the extension portion of the base defines a third threaded hole, the elongated handle capable of being attached to the extension portion of the base by screwing the threaded portion thereof into the third threaded hole.

* * * * *